US011170703B2

(12) United States Patent
Lee et al.

(10) Patent No.: US 11,170,703 B2
(45) Date of Patent: Nov. 9, 2021

(54) DISPLAY DEVICE AND DRIVING METHOD THEREOF

(71) Applicant: SAMSUNG DISPLAY CO., LTD., Yongin-si (KR)

(72) Inventors: Jae Hoon Lee, Yongin-si (KR); Sang Myeon Han, Yongin-si (KR); Jong Wook Kim, Yongin-si (KR); Byoung Kwan An, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/017,259

(22) Filed: Sep. 10, 2020

(65) Prior Publication Data

US 2021/0210000 A1 Jul. 8, 2021

(30) Foreign Application Priority Data

Jan. 8, 2020 (KR) ..... 10-2020-0002700

(51) Int. Cl.
*G09G 3/32* (2016.01)

(52) U.S. Cl.
CPC ..... *G09G 3/32* (2013.01); *G09G 2310/027* (2013.01); *G09G 2360/16* (2013.01)

(58) Field of Classification Search
CPC . G09G 2360/16; G09G 3/32; G09G 2310/027
See application file for complete search history.

(56) References Cited

U.S. PATENT DOCUMENTS

| | | | | |
|---|---|---|---|---|
| 10,283,043 | B2 * | 5/2019 | Lee | G09G 3/3233 |
| 2017/0069238 | A1 * | 3/2017 | Moon | G09G 3/007 |
| 2017/0069273 | A1 * | 3/2017 | Park | G09G 3/3233 |
| 2017/0076660 | A1 * | 3/2017 | Lee | G09G 3/3208 |
| 2018/0020525 | A1 * | 1/2018 | Moon | G09G 3/3233 |
| 2019/0164503 | A1 * | 5/2019 | An | G09G 3/3258 |

FOREIGN PATENT DOCUMENTS

| | | |
|---|---|---|
| KR | 10-2017-0077965 | 7/2017 |
| KR | 10-2018-0013527 | 2/2018 |

* cited by examiner

*Primary Examiner* — Muhammad N Edun
(74) *Attorney, Agent, or Firm* — F. Chau & Associates, LLC

(57) ABSTRACT

There are provided a display device, driving method and sensing unit thereof, where a display device includes a display unit having pixels connected to signal lines; a sensing unit including at least one current sensor connected to at least one of the signal lines; and a compensator connected between the sensing unit and the display unit, wherein the compensator is configured to: calculate degradation weights for positions of the pixels, based on a sensing current measured by the sensing unit and a predetermined reference current value, update degradation accumulated values for the positions whenever the sensing current is measured, by accumulating degradation degrees in which the degradation weights are reflected, generate compensated grayscale values by compensating input grayscale values based on the updated degradation accumulated values, and output the compensated grayscale values to the pixels.

19 Claims, 14 Drawing Sheets

DISPLAY DEVICE AND DRIVING METHOD THEREOF

CROSS-REFERENCE TO RELATED APPLICATION

The present application claims priority under 35 U.S.C. § 119 to Korean patent application 10-2020-0002700 filed on Jan. 8, 2020 in the Korean Intellectual Property Office, the entire disclosure of which is incorporated by reference.

TECHNICAL FIELD

The present disclosure generally relates to a display device and a driving method thereof.

DISCUSSION OF RELATED ART

With the development of information technologies, the importance of a display device, which is a connection medium between a user and information, increases. Accordingly, display devices such as a liquid crystal display device, an organic light emitting display device, and a plasma display device are increasingly used.

A display device may include a plurality of pixels, and the plurality of pixels emit light with various colors and luminances, thereby displaying various images.

The plurality of pixels may include pixel circuits having substantially the same structure. However, when the display device becomes large-sized, process variations according to positions of the pixels may occur. Therefore, transistors performing the same function in the respective pixels may have different characteristics such as mobilities or threshold voltages. Similarly, light emitting diodes of the respective pixels may have different threshold voltages.

In addition to the process variations, elements included in each pixel may have different degradation rates with respect to positions of the pixel, depending on use frequency, ambient temperature, and the like of the pixel in usage.

SUMMARY

Exemplary embodiments of the present disclosure may provide a display device capable of sensing characteristic information of each pixel with respect to positions of the pixel, and accurately compensating for the characteristic information with respect to the positions of the respective pixel.

In accordance with an embodiment of the present disclosure, a display device includes a display unit including pixels connected to signal lines; a sensing unit including at least one current sensor connected to at least one of the signal lines; and a compensator connected between the sensing unit and the display unit, wherein the compensator is configured to: calculate degradation weights for positions of the pixels, based on a sensing current measured by the sensing unit and a predetermined reference current value, update degradation accumulated values for the positions whenever the sensing current is measured, by accumulating degradation degrees in which the degradation weights are reflected, generate compensated grayscale values by compensating input grayscale values based on the updated degradation accumulated values, and output the compensated grayscale values to the pixels.

The pixels may be divided into a plurality of blocks. A number of the blocks may be smaller than or equal to that of the pixels. The sensing unit may measure sensing currents respectively generated from a plurality of pixels included in a block, and calculate a block current for each of the blocks, based on the measured sensing currents.

The compensator may calculate a block degradation weight corresponding to the block, based on a block current value and the reference current value, reflect the block degradation weight to a block degradation degree corresponding to the block, update a block degradation accumulated value by accumulating the block degradation degree, and generate a block output grayscale value for the block by reflecting the updated block degradation accumulated value to the input grayscale value.

The compensator may acquire a first block degradation degree corresponding to a first block and a second block degradation degree corresponding to at least one second block adjacent to the first block, calculate a difference value between the first block degradation degree and the second block degradation degree, and store information on the first block, when the difference value is a predetermined reference value or more.

The compensator may check whether the display device has been turned off, calculate a block current corresponding to the first block, when the display device is turned off, calculate a block degradation weight, based on a block current value corresponding to the first block and the reference current value, and update a block degradation accumulated value by accumulating the first block degradation degree to which the block degradation weight is reflected.

The pixel may include: a first transistor including a gate electrode coupled to a first node, a first electrode coupled to a first power source, and a second electrode coupled to a second node; a second transistor including a gate electrode coupled to a first scan line, a first electrode coupled to a data line, and a second electrode coupled to the first node; a third transistor including a gate electrode coupled to a second scan line, a first electrode coupled to the second node, and a second electrode coupled to a sensing line; and a light emitting diode including an anode coupled to the second node and a cathode coupled to a second power source.

When the sensing current is measured, a voltage corresponding to reference grayscale data may be applied to the first node. The reference grayscale data may be data obtained by compensating for a characteristic of the first transistor.

The characteristic of the first transistor may include at least one of a threshold voltage of the first transistor and a mobility.

A voltage of the second power source may be set higher than that of the first power source, while the sensing current is being measured.

The degradation accumulated value may increase as the degradation degree increases. The degradation degree may increase as the degradation weight increases. The degradation weight may be determined based on a ratio of the sensing current value to the reference current value.

The display device may further include a temperature sensor configured to measure an ambient temperature of the display unit. The compensator may accumulate the degradation degree by reflecting input grayscale values for the pixels and the ambient temperature to the degradation degree.

In accordance with another embodiment of the present disclosure, there is provided a display device including: a display unit including a plurality of pixels coupled to data lines, scan lines, and first power lines; a current sensor configured to a sensing current flowing in the first power line, and provide a sensing current value; and a compensator configured to calculate a degradation weight for each of positions of the pixels, based on the sensing current value and a predetermined reference current value, update a degradation accumulated value whenever the sensing current is measured by accumulating a degradation degree to which the degradation weight is reflected, and generate an output grayscale value by reflecting the updated degradation accumulated value to an input grayscale value input from the outside.

The pixels may be divided into a plurality of blocks. A number of the blocks may be smaller than or equal to that of the pixels. The current sensor may measure sensing currents respectively generated from a plurality of pixels included in a block, and calculate a block current for each of the blocks, based on the measured sensing currents.

The compensator may calculate a block degradation weight corresponding to the block, based on a block current value and the reference current value, reflect the block degradation weight to a block degradation degree corresponding to the block, update a block degradation accumulated value by accumulating the block degradation degree, and generate a block output grayscale value for the block by reflecting the updated block degradation accumulated value to the input grayscale value.

The compensator may acquire a first block degradation degree corresponding to a first block and a second block degradation degree corresponding to at least one second block adjacent to the first block, calculate a difference value between the first block degradation degree and the second block degradation degree, and store information on the first block, when the difference value is a predetermined reference value or more.

The compensator may check whether the display device has been turned off, calculate a block current corresponding to the first block, when the display device is turned off, calculate a block degradation weight, based on a block current value corresponding to the first block and the reference current value, and update a block degradation accumulated value by accumulating the first block degradation degree to which the block degradation weight is reflected.

In accordance with still another embodiment of the present disclosure, there is provided a method for driving a display device, the method including: measuring a sensing current for each of pixels included in the display device, and outputting a sensing current value; calculating a degradation weight for each of positions of the pixels, based on the sensing current value and a predetermined reference current value; updating a degradation accumulated value whenever the sensing current is measured by accumulating a degradation degree to which the degradation weight is reflected; and generating an output grayscale value by reflecting the updated degradation accumulated value to an input grayscale value input from the outside.

The pixels may be divided into a plurality of blocks. A number of the blocks may be smaller than or equal to that of the pixels. In the outputting of the sensing current value, sensing currents respectively generated from a plurality of pixels included in a block may be measured, and a block current may be calculated for each of the blocks, based on the measured sensing currents.

In the calculating of the degradation weight, a block degradation weight corresponding to the block may be calculated based on a block current value and the reference current value. In the updating of the degradation accumulated value, the block degradation weight may be reflected to a block degradation degree corresponding to the block, and a block degradation accumulated value may be updated by accumulating the block degradation degree. In the generating of the output grayscale value, a block output grayscale value for the block may be generated by reflecting the updated block degradation accumulated value to the input grayscale value.

The degradation accumulated value may increase as the degradation degree increases. The degradation degree may increase as the degradation weight increases. The degradation weight may be determined based on a ratio of the sensing current value to the reference current value.

In accordance with the present disclosure, there may be provided a display device capable of sensing characteristic information of each pixel with respect to positions of the pixel and accurately compensating for the characteristic information with respect to the positions of the pixel, and a driving method of the display device.

In accordance with another embodiment of the present disclosure, a sensing unit includes a plurality of channels, each channel connectable to a plurality of display pixels and comprising: a sensing line switchably connectable to each of the plurality of display pixels; an amplifier having an inverting input switchably connectable to the sensing line, a non-inverting input, and an output switchably connectable to the inverting input; a sensing capacitor connected between the output and the inverting input; and a sampling capacitor switchably connectable between the output and a ground potential.

Each channel of the sensing unit may include an analog-to-digital converter switchably connectable to the output. Or, the sensing unit may include an analog-to-digital converter switchably connectable to the output of each channel.

The sensing unit may include a reference potential connected to the non-inverting input of each channel. The sensing unit may include an initialization potential switchably connectable to the inverting input of each channel. The sensing unit may include a temperature sensor coupled in signal communication to the analog-to-digital converter.

BRIEF DESCRIPTION OF THE DRAWINGS

Exemplary embodiments will now be described more fully hereinafter with reference to the accompanying drawings; however, other embodiments may be embodied in different forms and should not be construed as limited to the embodiments set forth herein. Rather, these embodiments are provided so that this disclosure will be thorough and complete, and will fully convey the scope and spirit of the present disclosure to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals may refer to like elements throughout.

DETAILED DESCRIPTION

Figure 1:
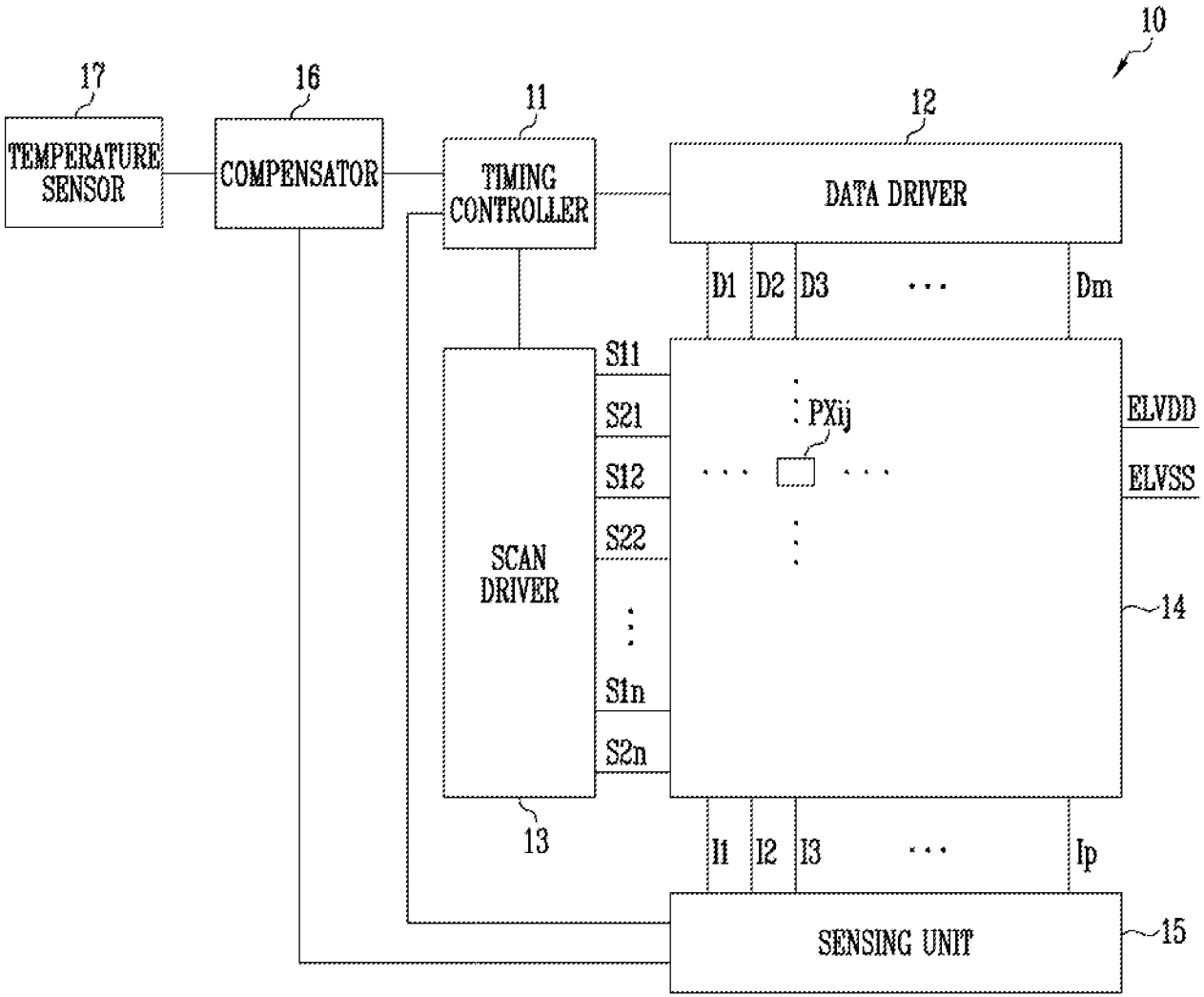
FIG. 1 is a diagram illustrating a display device in accordance with an embodiment of the present disclosure.

Exemplary embodiments of the present disclosure may be clear by referring to the embodiments described below in detail together with the accompanying drawings. However, the present disclosure is not limited to the embodiments disclosed herein but may be implemented in various forms. The embodiments are provided by way of example only so that a person of ordinary skilled in the art may fully understand the features in the present disclosure and the scope thereof. Therefore, the present disclosure may be defined by the scope of the appended claims.

Although the terms "first," "second," and the like are used for describing various components, these components are not confined by these terms. These terms are merely used for distinguishing one component from the other components. Therefore, a first component may be a second component or vice versa according to the technical concepts of the present disclosure.

Hereinafter, exemplary embodiments will be described with reference to the accompanying drawings. Throughout the drawings, the same reference numerals are given to the same elements.

An exemplary embodiment technique senses characteristic information of display pixels, such as mobilities, threshold voltages, and the like of elements included in pixels and compensates for characteristic information changed depending on degradation. In addition, a technique is provided that accurately compensates for characteristic information by continuously reflecting the characteristic information into logic for compensating for different degradation degrees with respect to positions of each respective pixel.

FIG. 1 illustrates a display device in accordance with an embodiment of the present disclosure.

Referring to FIG. 1, the display device 10 in accordance with the embodiment of the present disclosure may include a timing controller 11, a data driver 12, a scan driver 13, a display unit 14, a sensing unit 15, a compensator 16, a temperature sensor 17, and the like.

The timing controller 11 may receive various grayscale values or grayscale data and control signals for each image frame from an external processor. The timing controller 11 may render grayscale values to correspond to specifications of the display device 10. For example, the external processor may provide a red grayscale value, a green grayscale value, and a blue grayscale value with respect to each unit dot. However, when the display unit 14 has a PenTile® pixel matrix structure, such as PenTile® Red-Green-Blue-Red-Green or Red-Green-Blue-Green in an active-matrix display, or Red-Green-Blue-White in a passive-matrix display, adjacent unit dots share a pixel, and therefore, pixels may not correspond one-to-one to the respective grayscale values. Accordingly, it may be necessary to render the grayscale values. When pixels may correspond one-to-one to the respective grayscale values, it may be unnecessary to render the grayscale values.

Grayscale values which are rendered or are not rendered may be provided to the data driver 12. Also, the timing controller 11 may provide the data driver 12, the scan driver 13, the sensing unit 15, or the like with control signals suitable for the specifications of the data driver 12, the scan driver 13, the sensing unit 15, or the like for the purpose of frame display.

The data driver 12 may generate data voltages to be provided to data lines D1, D2, D3, . . . , and Dm by using grayscale values and control signals. For example, the data driver 12 may sample the grayscale values by using a clock signal, and apply data voltages corresponding to the sampled grayscale values to the data lines D1 to Dm in a unit of a pixel row. Here, m may be an integer greater than 0.

The scan driver 13 may generate first scan signals to be provided to first scan lines S11, S12, . . . , and S1*n*, and second scan signals to be provided to second scan lines S21, S22, . . . , and Stn, by receiving a clock signal, a scan start signal, and the like from the timing controller 11. Here, n may be an integer greater than 0.

The scan driver 13 may sequentially supply first scan signals having a pulse of a turn-on level to the first scan lines S11, S12, . . . , and S1*n*. Also, the scan driver 13 may sequentially supply second scan signals having a pulse of a turn-on level to the second scan lines S21, S22, . . . , and Stn.

The scan driver 13 may include a first scan driver coupled to the first scan lines S11, S12, . . . , and Sin and a second scan driver coupled to the second scan lines S21, S22, . . . , and Stn. Each of the first scan driver and the second scan driver may include scan stages configured in the form of shift registers. Each of the first scan driver and the second scan driver may generate scan signals in a manner that sequentially transfers a scan start signal in the form of a pulse of a turn-on level to a next scan stage under the control of the clock signal.

Figure 14:
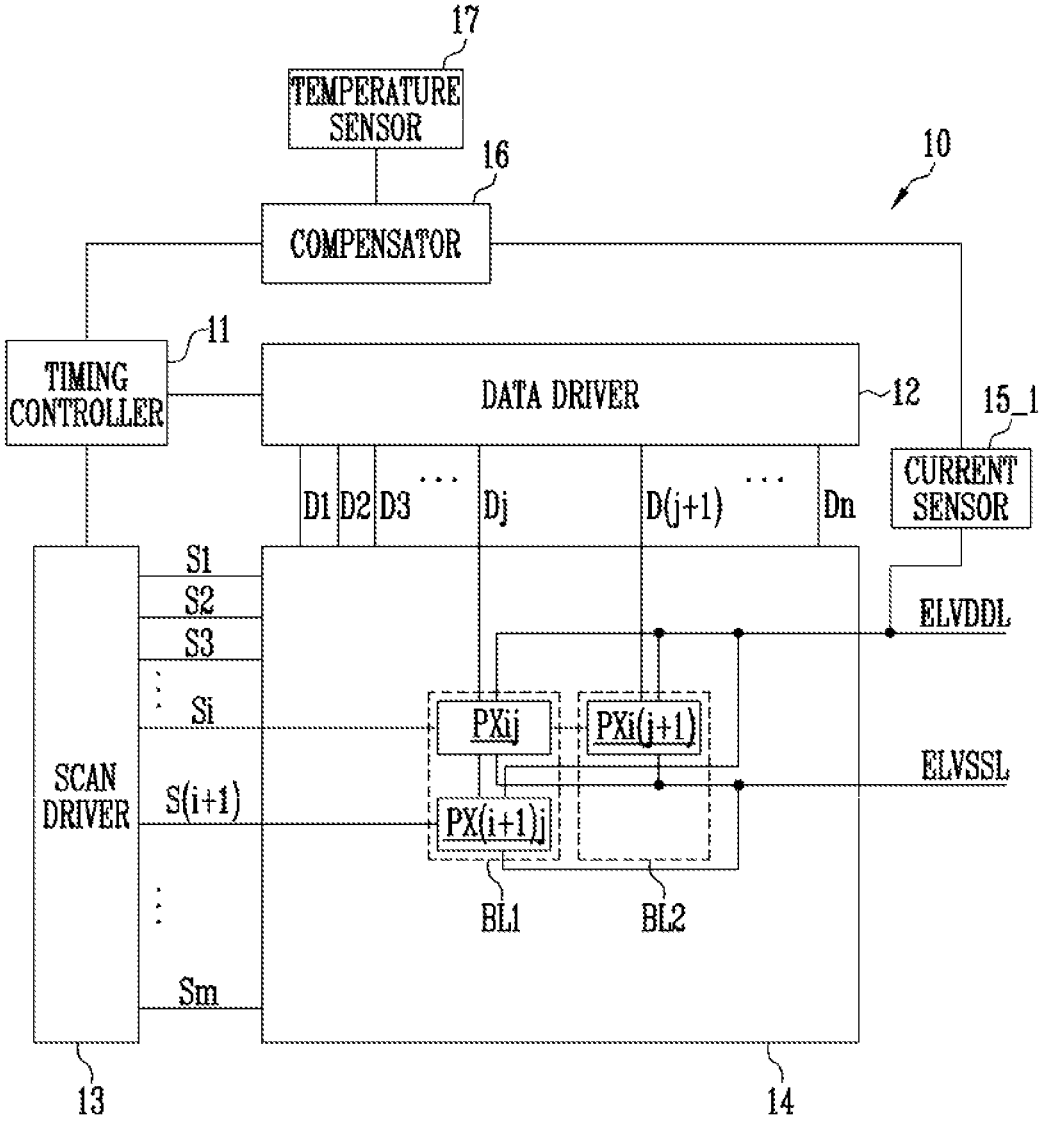
FIG. 14 is a diagram illustrating a display device in accordance with another embodiment of the present disclosure.

The first scan driver for first scan signals and the second scan driver for second scan signals may be separately configured as described in this embodiment. In other embodiments, the first scan signals and the second scan signals may be from the same scan driver, such as shown in FIG. 14. That is, a first scan line and a second scan line, which are coupled to each pixel PXij in a respective pixel row i, may be coupled to the same node. There, the scan driver 13 need not be divided into a first scan driver and a second driver, and may instead be configured as a single scan driver.

The sensing unit 15 may supply an initialization voltage to sensing lines I1, I2, I3, . . . , and Ip by receiving a control signal, or may receive a sensing signal. For example, the sensing unit 15 may supply an initialization voltage to the sensing lines I1, I2, I3, . . . , and Ip during at least a partial period in a display period. For example, the sensing unit 15 may receive a sensing signal through the sensing lines I1, I2, I3, . . . , and Ip during at least a partial period in a sensing period. Here, p may be an integer greater than 0.

The sensing unit 15 may include sensing channels coupled to the sensing lines I1, I2, I3, . . . , and Ip. For example, the sensing lines I1, I2, I3, . . . , and Ip and the sensing channels may correspond one-to-one to each other. This will be described with reference to FIGS. 4 to 8.

The data driver 12 and the sensing unit 15 may be separately configured as shown in this embodiment. However, in another embodiment, the data driver 12 and the sensing unit 15 may be integrally configured.

The display unit 14 may include pixels. Each pixel PXij may be coupled to a corresponding data line, a corresponding scan line, and a corresponding sensing line. The pixels PXij may be divided into a plurality of blocks. For example, each of the blocks may include the same number of pixels, and the blocks need not overlap with each other. In another embodiment, the blocks may include different numbers of pixels. In another embodiment, the blocks may share at least some pixels or partially overlap with each other.

Each block is used to define a control unit with respect to a plurality of pixels. Each block is a virtual component, and is not any physical component. Such blocks may be defined to include particular pixels as written to a memory before a product is released, and may be actively re-defined as the product is used.

The sensing unit 15 may measure a sensing current for each pixel, and output a sensing current value. Specifically, the sensing unit 15 may sense a sensing current value by sensing a sensing current of only some pixels or sensing a sensing current of all pixels with respect to each block, according to a control signal supplied from the timing controller 11. The sensing unit 15 may be implemented as a sensing channel as may be described later in greater detail.

The compensator 16 may calculate a degradation weight for each of the positions of pixels, based on a sensing current value and a predetermined reference current value, update a degradation accumulated value by accumulating a degradation degree to which the degradation weight is reflected, and generate an output grayscale value by reflecting the updated degradation accumulated value to an input grayscale value input from the outside.

The reference current value may mean a current value predicted when reference grayscale data is input from the outside at a reference temperature. The reference current value may be pre-stored in a memory before a product is released, and may be actively re-defined when the product is used.

The degradation weight may mean a parameter which reflects a characteristic deviation for each of the positions of a plurality of pixels. The degradation weight may be set as an initialization value before a product is released, and may be updated according to a sensing current measured when the product is used. The degradation weights may be provided in a plurality to correspond to the respective pixels. When the plurality of pixels are divided into the above-described blocks, a degradation weight may be set to correspond to each of the blocks. A degradation weight corresponding to a specific block may be referred to as a block degradation weight. This may be described in greater detail later with reference to FIGS. 12 and 13.

The degradation degree may represent a degree to which a specific pixel is degraded according to the magnitude thereof. The above-described degradation weight, a grayscale acceleration according to a grayscale value compensated and output when a predetermined grayscale value is input, a temperature acceleration according to an internal temperature in the display device 10, and the like may be reflected in the degradation degree. As described above, the degradation degree may also be provided in a plurality to correspond to the respective pixels, and/or be provided in a plurality to correspond to respective blocks in which a certain or variable number of pixels are included. A degradation degree corresponding to a specific block may be referred to as a block degradation degree.

The degradation accumulated value may mean a value obtained by accumulating the degradation degree, and may mean a value used to compensate for the input grayscale value input from the outside. Specifically, a degradation accumulated value in a current image frame may be updated by adding the degradation degree to a degradation accumulated value up to a previous image frame. As described above, the degradation accumulated value may also be provided in a plurality to correspond to respective pixels, and/or may be provided in a plurality to correspond to respective blocks. A degradation accumulated value corresponding to a specific block may be referred to as a block degradation accumulated value.

The input grayscale value is grayscale data input from the external processor, and may mean grayscale data with respect to an image frame. In addition, the output grayscale value may mean grayscale data as the input grayscale value compensated by the compensator 16 to be input to the data driver 12.

In an embodiment, when the compensator 16 receives input grayscale values for pixels and an ambient temperature, the compensator 16 may calculate a degradation degree by using the input grayscale values for the pixels and the ambient temperature. Also, the compensator 16 may update a degradation accumulated value by adding the calculated degradation degree to the existing degradation accumulated value, and generate an output grayscale value by reflecting the updated degradation accumulated value to the input grayscale values.

The temperature sensor 17 may measure an ambient temperature of the display device. Specifically, the temperature sensor 17 may measure an ambient temperature of the display unit 14, and output information regarding the measured ambient temperature to the compensator 16. In an embodiment, when pixels are divided or grouped into blocks, the temperature sensor 17 may measure ambient temperatures for the respective blocks in a unit of a block. Embodiments of the present disclosure may be implemented with only one temperature sensor 17, but are not limited thereto.

Figure 2:
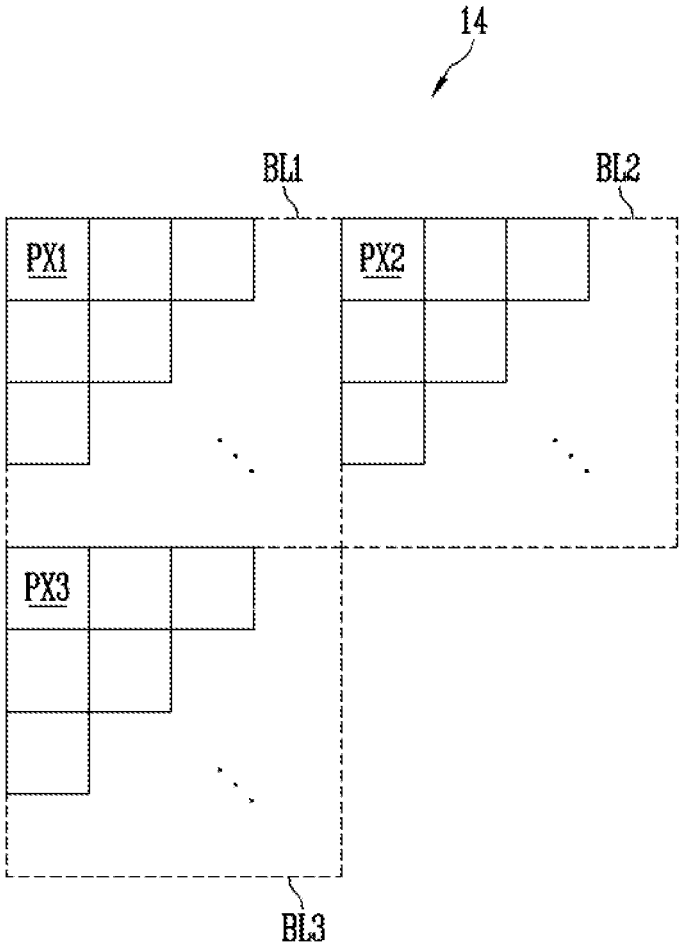
FIG. 2 is a diagram illustrating a pixel unit in accordance with an embodiment of the present disclosure.

FIG. 2 illustrates a pixel array in accordance with an embodiment of the present disclosure.

Referring to FIG. 2, pixels PX1, PX2, and PX3 may be separately grouped into blocks BL1, BL2, and BL3, respectively. A number of the blocks BL1, BL2, and BL3 may be smaller than or equal to that of the number of pixels PX1, PX2, and PX3. For example, each of the blocks BL1, BL2, and BL3 may include one or more pixels PX1, PX2 or PX3.

When each of the blocks BL1, BL2, and BL3 includes only one pixel PX1, PX2 or PX3, that is, when the number of the blocks BL1, BL2, and BL3 is equal to that of the pixels PX1, PX2, and PX3, the most accurate degradation compensation is made, but data storage cost and operation cost are increased.

When each of the blocks BL1, BL2, and BL3 includes two or more pixels PX1, PX2 or PX3, that is, when the number of the blocks BL1, BL2, and BL3 is smaller than that of the pixels PX1, PX2, and PX3, data storage cost and operation cost are decreased, but the most accurate degradation compensation is not made. A manufacturer of the display device 10 may determine a size of the blocks BL1, BL2, and BL3 by considering such a trade-off relationship.

Although a case where the number of the blocks BL1, BL2, and BL3 is 3 is illustrated in FIG. 2, this is merely an example for describing the embodiments of the present disclosure, and the present disclosure is not limited thereto.

When the display unit 14 has a resolution of an Ultra High Definition (UHD), the display unit 14 may include 3840*2160 pixels. For example, 3840 pixels may exist on one horizontal line. For example, 3840 pixels may be coupled to each scan line. For example, 2160 pixels may exist on one vertical line. For example, 2160 pixels may be coupled to one data line. Each block may include the same number of pixels, but is not limited thereto. When a number of the blocks is N, where N is a natural number, one block may include 3840*2160/N pixels, for example.

Figure 3:
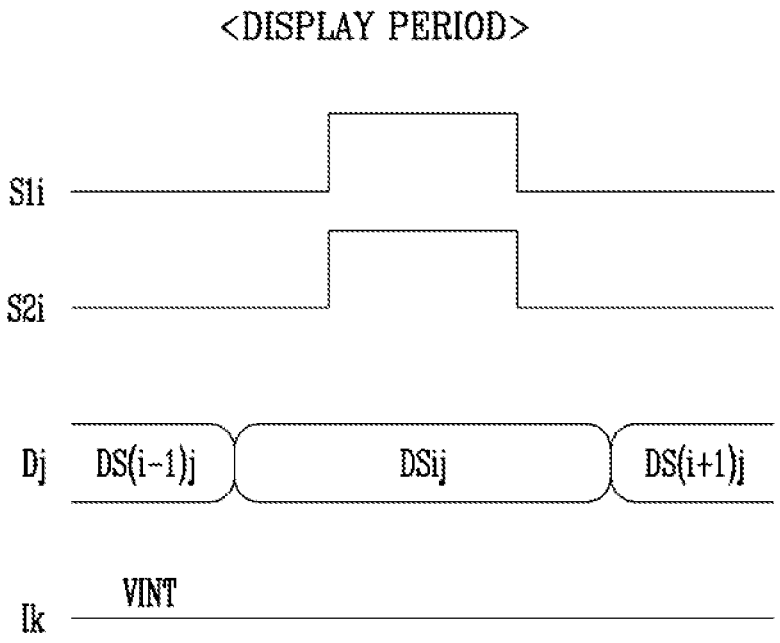
FIGS. 3 and 4 are diagrams illustrating a display period of a pixel in accordance with an embodiment of the present disclosure.
Figure 4:
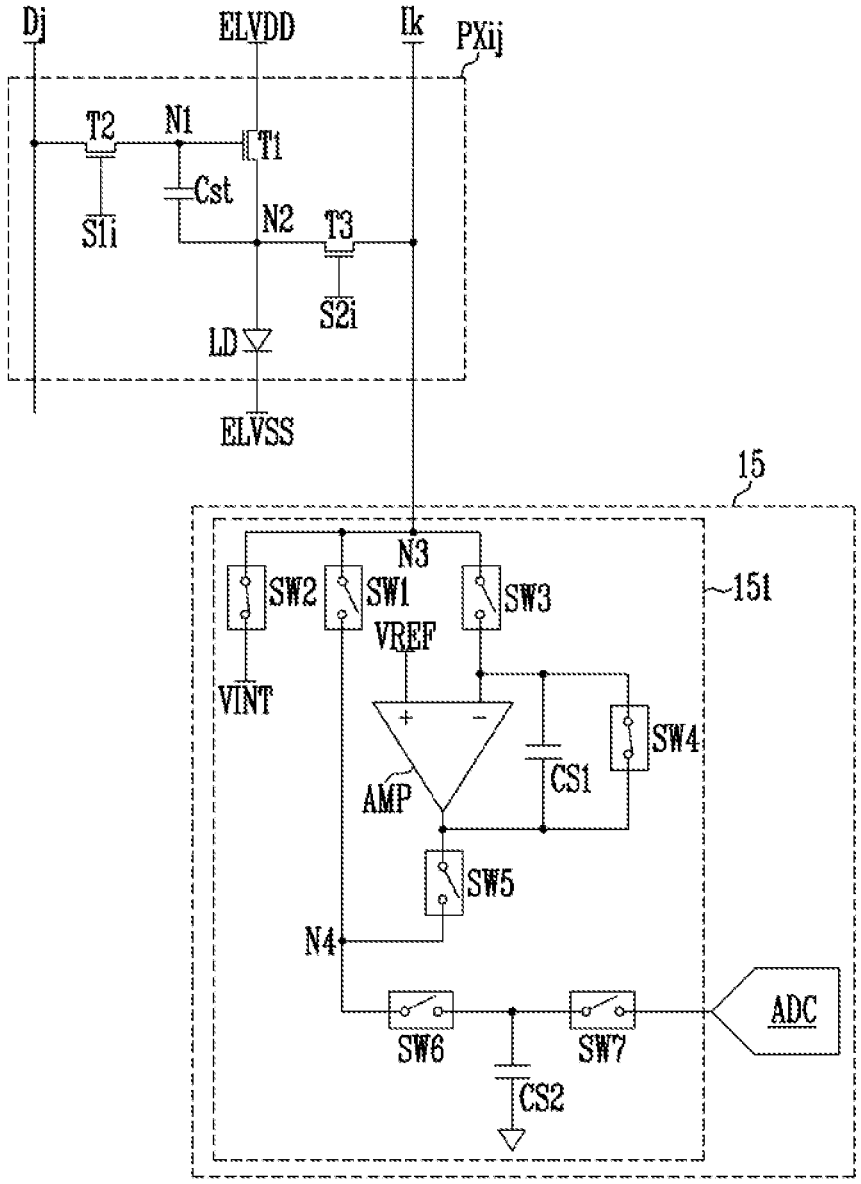

FIGS. 3 and 4 illustrate a display period of the pixel in accordance with an embodiment of the present disclosure.

Referring to FIG. 3, an exemplary waveform of signals is applied to scan lines S1*i* and S2*i*, a data line Dj, and a sensing line Ik, which are coupled to the pixel PXij, during the display period. Here, k may be an integer greater than 0, and k may but need not equal j.

Referring to FIG. 4, an exemplary configuration of the pixel PXij and a sensing channel 151 will be described.

The pixel PXij may include transistors T1, T2, and T3, a storage capacitor Cst, and a light emitting diode LD.

The transistors T1, T2, and T3 may be implemented with N-type transistors. In another embodiment, the transistors T1, T2, and T3 may be implemented with P-type transistors. In another embodiment, the transistors T1, T2, and T3 may be implemented with a combination of N-type and P-type transistors. In another embodiment, T1, T2, and T3 may be implemented with a combination of at least one transistor and at least one trancitor. For example, the transistor T2 and the storage capacitor Cst may be integrated as a controlled voltage source or trancitor.

The P-type transistor generally refers to a transistor in which an amount of current conducted increases when a voltage difference between a gate electrode and a source electrode increases in a negative direction. The N-type transistor generally refers to a transistor in which an amount of current conducted increases when a voltage difference between a gate electrode and a source electrode increases in a positive direction. The transistor may be configured in various forms such as a Thin Film Transistor (TFT), a Field Effect Transistor (FET), and a Bipolar Junction Transistor (BJT). When integrated with the storage capacitor Cst, one or more of the transistors T1, T2 or T3 may be implemented as a voltage-controlled trancitor or as a current-controlled trancitor, without limitation.

A gate electrode of a first transistor T1 may be coupled to a first node N1, a first electrode of the first transistor T1 may be coupled to a first power source ELVDD, and a second electrode of the first transistor T1 may be coupled to the second node N2. The first transistor T1 may be referred to as a driving transistor.

A gate electrode of a second transistor T2 may be coupled to a first scan line S1*i*, a first electrode of the second transistor T2 may be coupled to the data line Dj, and a second electrode of the second transistor T2 may be coupled to the first node Ni. The second transistor T2 may be referred to as a scanning transistor.

A gate electrode of a third transistor T3 may be coupled to a second scan line S2*i*, a first electrode of the third transistor T3 may be coupled to the second node N2, and a second electrode of the third transistor T3 may be coupled to the sensing line Ik. The third transistor T3 may be referred to as a sensing transistor.

A first electrode of the storage capacitor Cst may be coupled to the first node N1, and a second electrode of the storage capacitor Cst may be coupled to the second node N2.

The light emitting diode LD is an element which emits light with a luminous flux or luminance responsive to the forward current flowing through it. An anode of the light emitting diode LD may be coupled to the second node N2, and a cathode of the light emitting diode LD may be coupled to a second power source ELVSS.

In general, a voltage of the first power source ELVDD may be greater than that of the second power source ELVSS. However, the voltage of the second power source ELVSS may be set greater than that of the first power source ELVDD in a special situation such as a situation in which emission of the light emitting diode LD is prevented.

The sensing channel 151 may include switches SW1 to SW7, a sensing capacitor CS1, an amplifier AMP, and a sampling capacitor CS2. Here, switches SW2 and SW4 are in a closed or turn-on state, while switches SW1, SW3, SW5, SW6 and SW7 are in an opened or turn-off state.

One end of a second switch SW2 may be coupled to a third node N3, and the other end of the second switch SW2 may be coupled to an initialization power source VINT.

A first input terminal, such as a non-inverting terminal, of the amplifier AMP may be coupled to a reference voltage source VREF. The amplifier AMP may be configured as an operational amplifier.

One end of a third switch SW3 may be coupled to the third node N3, and the other end of the third switch SW3 may be coupled to a second input terminal, such as an inverting terminal, of the amplifier AMP.

A first electrode of the sensing capacitor CS1 may be couple to the second input terminal of the amplifier AMP, and a second electrode of the sensing capacitor CS1 may be coupled to an output terminal of the amplifier AMP.

The sampling capacitor CS2 may be coupled to the sensing capacitor CS1 through at least one switch SW5 and SW6.

One end of a fourth switch SW4 may be coupled to the first electrode of the sensing capacitor CS1, and the other end of the fourth switch SW4 may be coupled to the second electrode of the sensing capacitor CS1.

One end of a fifth switch SW5 may be coupled to the output terminal of the amplifier AMP, and the other end of the fifth switch SW5 may be coupled to a fourth node N4.

One end of a sixth switch SW6 may be coupled to the fourth node N4, and the other end of the sixth switch SW6 may be coupled to a first electrode of the sampling capacitor CS2.

One end of a seventh switch SW7 may be coupled to the first electrode of the sampling capacitor CS2, and the other end of the seventh switch SW7 may be coupled to an analog-to-digital converter ADC.

One end of a first switch SW1 may be coupled to the third node N3, and the other end of the first switch SW1 may be coupled to the fourth node N4.

The sensing unit 15 may include the sensing channel 151 and the analog-to-digital converter ADC. For example, the sensing unit 15 may include analog-to-digital converters corresponding to a number of sensing channels. In another example, the sensing unit 15 may include a single analog-to-digital converter, and time-divisionally convert sampling signals stored in the sensing channels.

Referring back to FIG. 3, the sensing line Ik is coupled to the initialization power source VINT during the display period. The second switch SW2 may be in a turn-on state during the display period.

During the display period, the first switch SW1 and the third switch SW3 may be in a turn-off state. Thus, the sensing line Ik may be prevented from being coupled to another power source VREF.

During the display period, data voltages DS(i−1)j, DSij, and DS(i+1)j may be sequentially applied to the data line Dj in a unit of a horizontal period. A scan signal having a turn-on level (high level) may be applied to the first scan line S1*i* in a corresponding horizontal period. In addition, a scan signal having a turn-on level may also be applied to the second scan line S2*i* in synchronization with the first scan line S1*i*. In another embodiment, during the display period, a scan signal having a turn-on level may be always applied to the second scan line S2*i*.

For example, when a scan signal having a turn-on level is applied to the first scan line S1*i* and the second scan line S2*i*, the second transistor T2 and the third transistor T3 may be in the turn-on state. Therefore, a voltage corresponding to the difference between the data voltage DSij and the initialization power source VINT is written to the storage capacitor Cst of the pixel PXij.

In the pixel PXij, an amount of driving current flowing along a driving path through which the first power source ELVDD, the first transistor T1, and the second power source ELVSS are coupled to each other is determined according to a voltage difference between the gate electrode and a source electrode of the first transistor T1. An emission luminance of the light emitting diode LD may be determined according to the amount of driving current.

Subsequently, when a scan signal having a turn-off level, such as a low level, is applied to the first scan line S1*i* and the second scan line S2*i*, the second transistor T2 and the third transistor T3 may be in the turn-off state. Thus, the voltage difference between the gate electrode of the source electrode of the first transistor T1 may be maintained by the storage capacitor Cst, regardless of a change in voltage of the data line Dj, and the emission luminance of the light emitting diode LD may be maintained.

Figure 5:
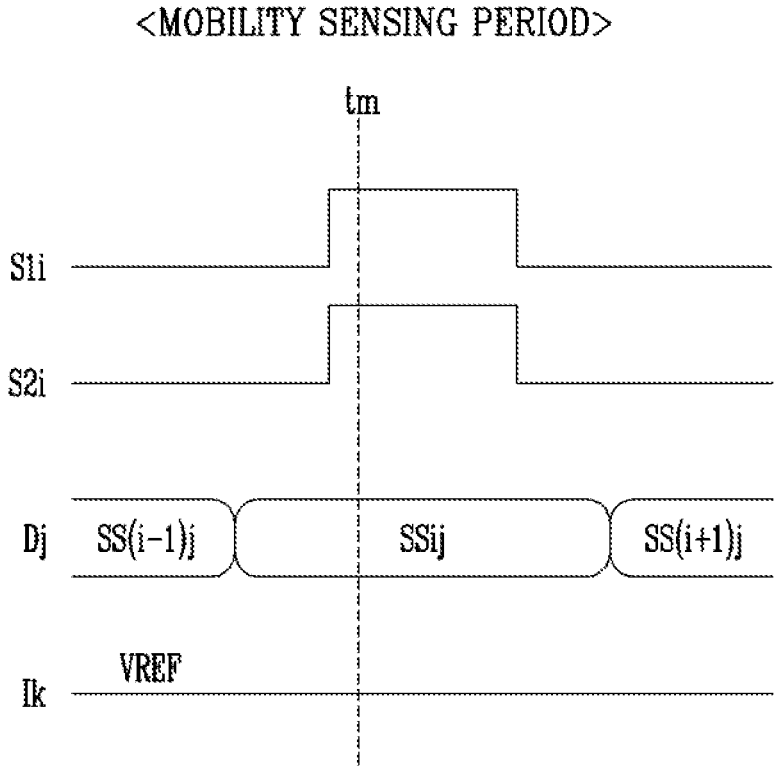
FIGS. 5 and 6 are diagrams illustrating a mobility sensing period of a driving transistor in accordance with an embodiment of the present disclosure.
Figure 6:
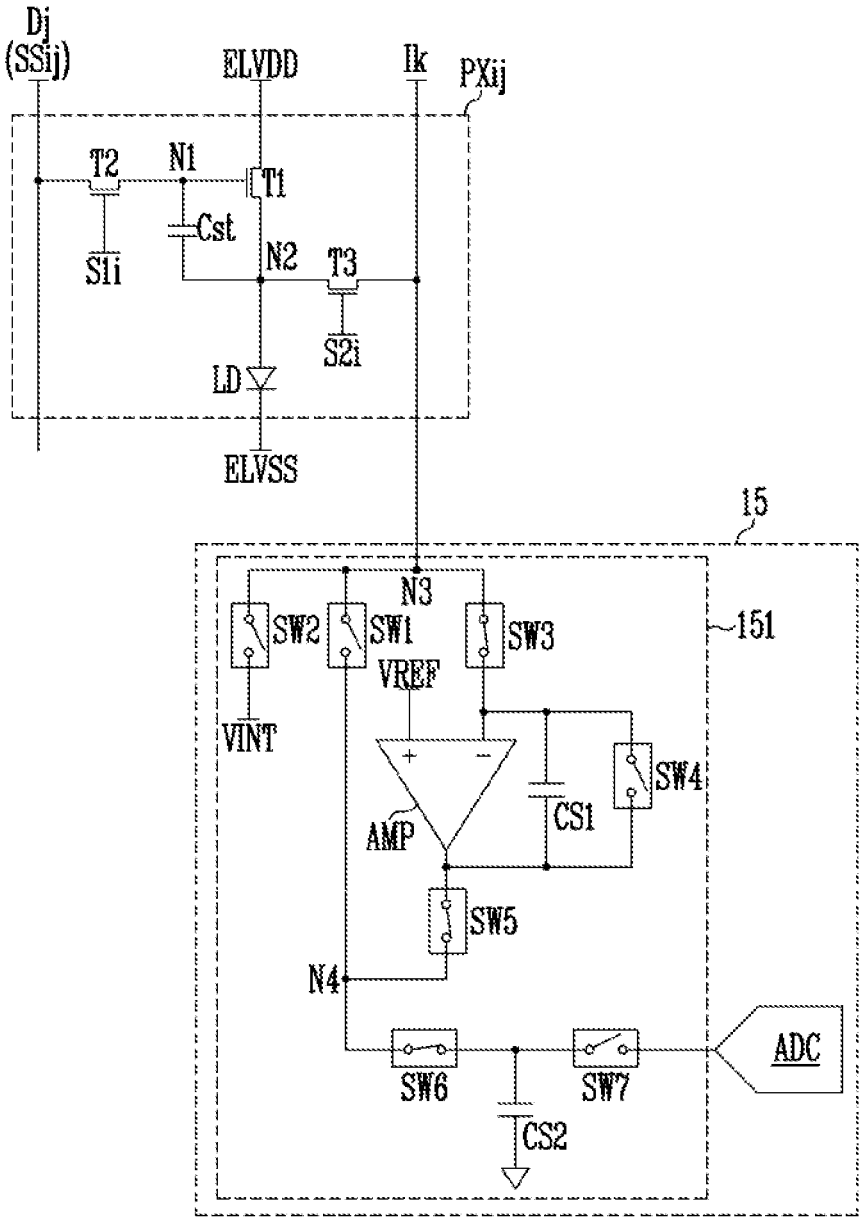

FIGS. 5 and 6 illustrate a mobility sensing period of the driving transistor in accordance with an embodiment of the present disclosure. Here, switches SW3, SW5 and SW6 are in a closed or turn-on state, while switches SW1, SW2, SW4 and SW7 are in an opened or turn-off state.

Referring to FIG. 5, an exemplary waveform of signals is applied to the scan lines S1*i* and S2*i*, the data line Dj, and the sensing line Ik, which are coupled to the pixel PXij, during the mobility sensing period. A state of the pixel PXij and the sensing channel 151 at a time tm shown in FIG. 5 is illustrated in FIG. 6.

Sensing voltages SS(i−1)j, SSij, and SS(i+1)j may be sequentially applied to the data line Dj. In some embodiments, when only sensing on one pixel row (i.e., pixels coupled to the same scan line) is performed during the mobility sensing period, only the sensing voltage SSij may be applied to the data line Dj, and the other sensing voltages SS(i−1)j and SS(i+1)j may not be applied to the data line Dj.

The sensing line Ik may be coupled to the reference power source VREF. Referring to FIG. 6, the third switch SW3 may be in the turn-on state. The non-inverting terminal and the inverting terminal of the amplifier AMP are in a virtual short state, and therefore, it may be expressed that the sensing line Ik has been coupled to the reference power source VREF.

When scan signals having a turn-on level are applied to the first scan line S1*i* and the second scan line S2*i* in synchronization with the sensing voltage SSij, the second transistor T2 and the third transistor T3 may be turned on.

Therefore, the sensing voltage SSij may be applied to the first node N1 of the pixel PXij, and a voltage of the reference power source VREF may be applied to the second node N2 of the pixel PXij. The difference between the sensing voltage SSij and the voltage of the reference power source VREF may be greater than a threshold voltage of the first transistor T1. Therefore, the first transistor T1 is turned on, and a sensing current flows along a sensing current path through which the first power source ELVDD, the first transistor T1, the second node N2, the third transistor T3, the third node N3, the third switch SW3, and the first electrode of the sensing capacitor CS1 are coupled to each other. The sensing current may include characteristic information of the first transistor T1 as set forth in Equation 1.

$$Id = \frac{1}{2}(u \times Co)\left(\frac{W}{L}\right)(Vgs - Vth)^2 \quad \text{(Equation 1)}$$

In Equation 1, Id may be a sensing current flowing through the first transistor T1, p may be a mobility, Co may be a capacitance formed between a channel of the first transistor T1, an insulating layer, and the gate electrode of the first transistor T1, W may be a width of the channel of the first transistor T1, L may be a length of the channel of the first transistor T1, Vgs may be a voltage difference between the gate electrode and the source electrode of the first transistor T1, and Vth may be a threshold voltage value of the first transistor T1.

Figure 7:
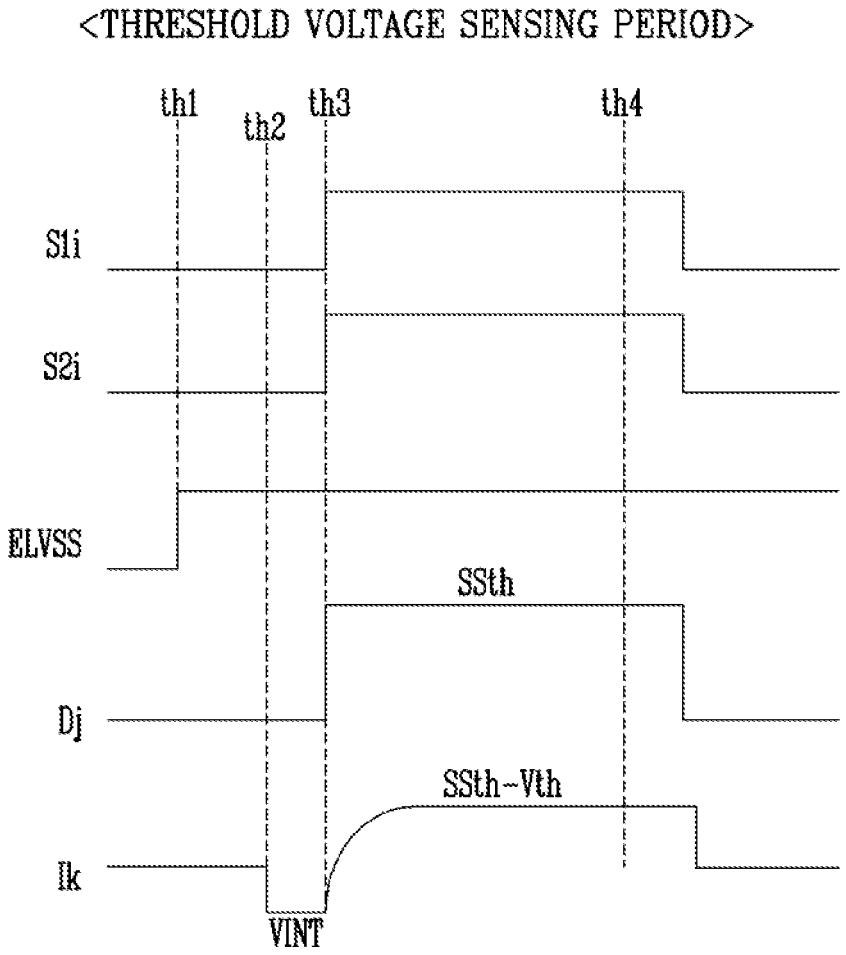
FIGS. 7 and 8 are diagrams illustrating a threshold voltage sensing period of the driving transistor in accordance with an embodiment of the present disclosure.

Co, W, and L are fixed constants. Vth may be detected using another detection method, such as shown in FIGS. 7 and/or 8. Vgs is a difference between the sensing voltage SSij and the voltage of the reference power source VREF. Since the voltage of the third node N3 is fixed, the voltage of the fourth node N4 is decreased as the sensing current Id is increased. The voltage of the fourth node N4 may be stored as a sampling signal in the sampling capacitor CS2. Subsequently, the analog-to-digital converter ADC may convert the sampling signal stored in the sampling capacitor Cs2 into a digital signal through the turned-on seventh switch SW7, thereby calculating a magnitude of the sensing current Id. Therefore, the mobility as a remaining variable may be obtained.

Figure 8:
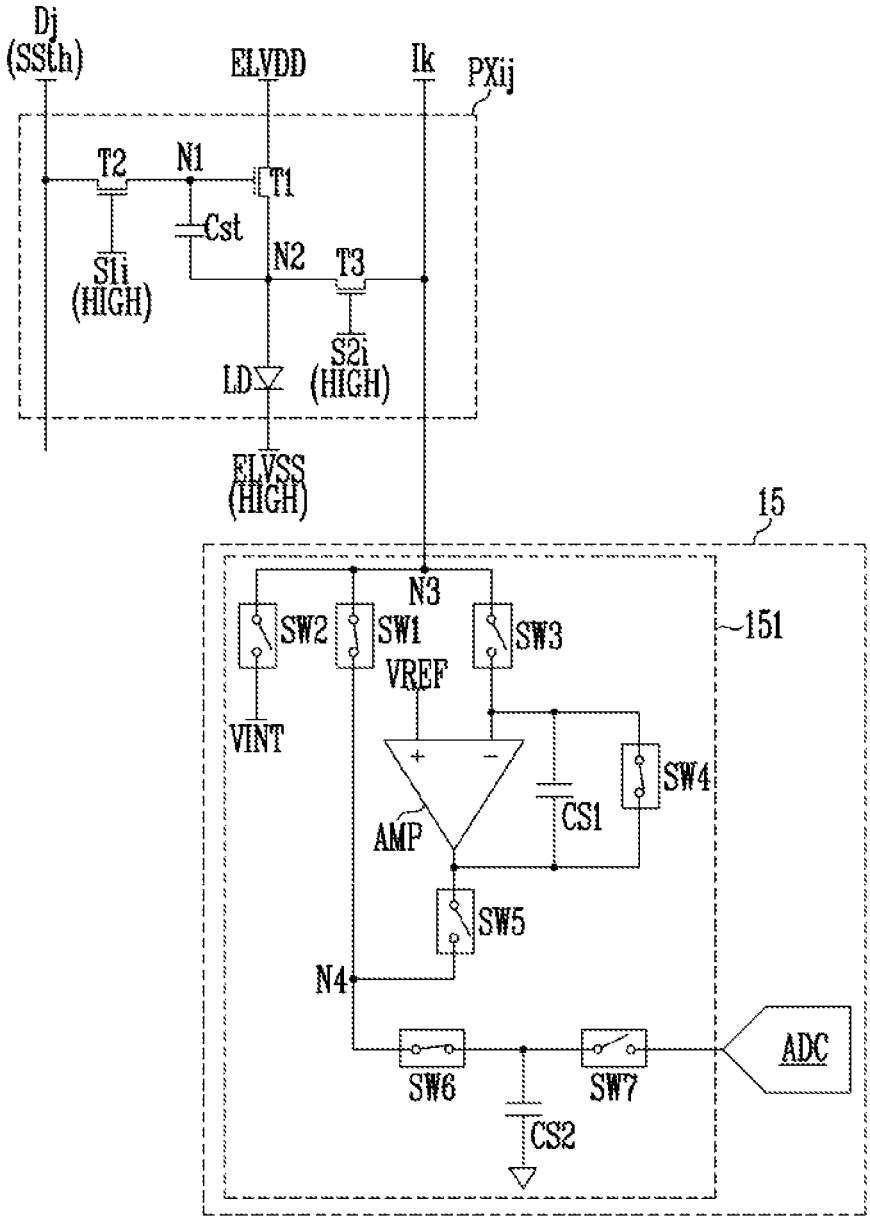

FIGS. 7 and 8 illustrate a threshold voltage sensing period of the driving transistor in accordance with an embodiment of the present disclosure. Here, switches SW1, SW4 and SW6 are in a closed or turn-on state, while switches SW2, SW3, SW5 and SW7 are in an opened or turn-off state.

Referring to FIG. 8, a state of the pixel PXij and the sensing channel 151 at a time th4 shown in FIG. 7 is illustrated in FIG. 8. The third switch SW3 and the fifth switch SW5 may maintain the turn-off state, and the first switch SW may maintain the turn-on state.

Referring to FIG. 7, at a time th1, the voltage of the second power source ELVSS is increased, so that emission of the light emitting diode LD may be prevented in advance.

Next, at a time th2, the second switch SW is turned on, so that the sensing line Ik may be initialized to the voltage of the initialization voltage VINT.

Next, at a time th3, scan signals having a turn-on level may be applied to the first scan line S1*i* and the second scan line S2*i*. A sensing voltage SSth may be applied to the data line Dj. Therefore, the sensing voltage SSth may be maintained in the first node N1. In addition, the initialization line Ik may be coupled to the second node N2.

The voltage of the second node N2 may be increased from the voltage of the initialization power source VINT to a voltage SSth-Vth. When the voltage of the second node N2 is increased up to the voltage SSth-Vth, the first transistor T1 is turned off, so that the voltage of the second node N2 is not increased any more.

The sixth switch SW6 may be in the turn-on state, and therefore, a sampling signal may be stored in the sampling capacitor CS2. Since the fourth node N4 and the second node N2 are coupled to each other, the sampling signal includes the threshold voltage value Vth of the first transistor T1. The seventh transistor T7 is turned on, so that the analog-to-digital converter ADC may convert the sampling signal into a digital signal.

Figure 9:
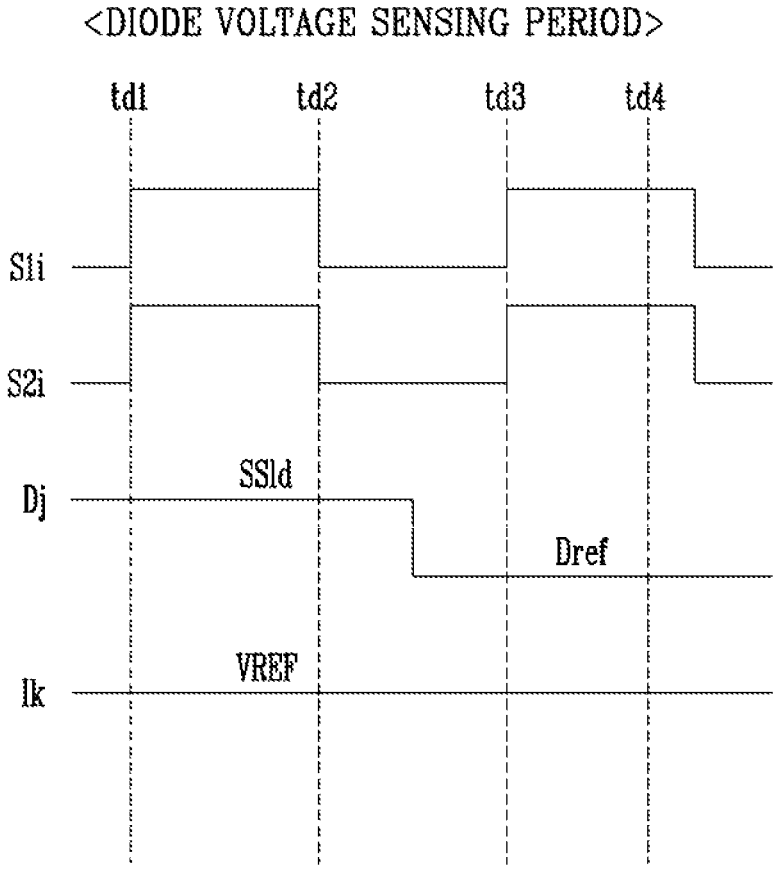
FIGS. 9 to 11 are diagrams illustrating a threshold voltage sensing period of a light emitting diode in accordance with an embodiment of the present disclosure.
Figure 10:
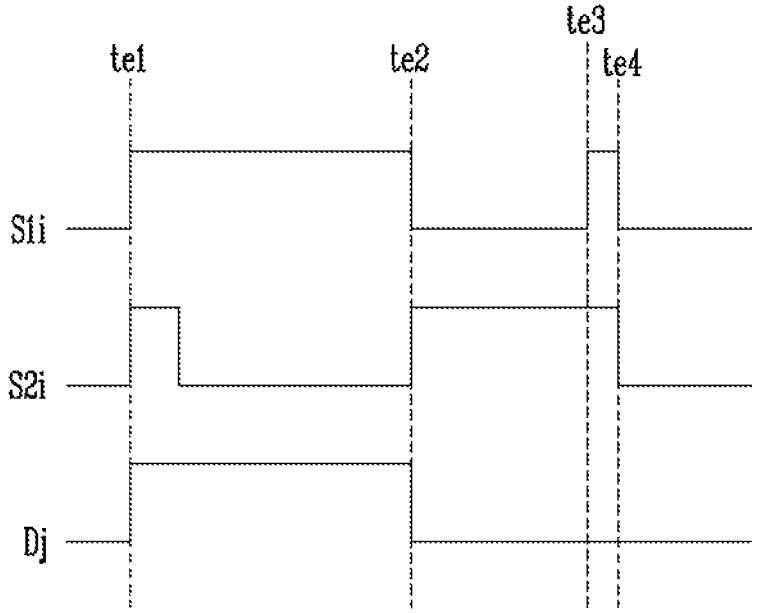
Figure 11:
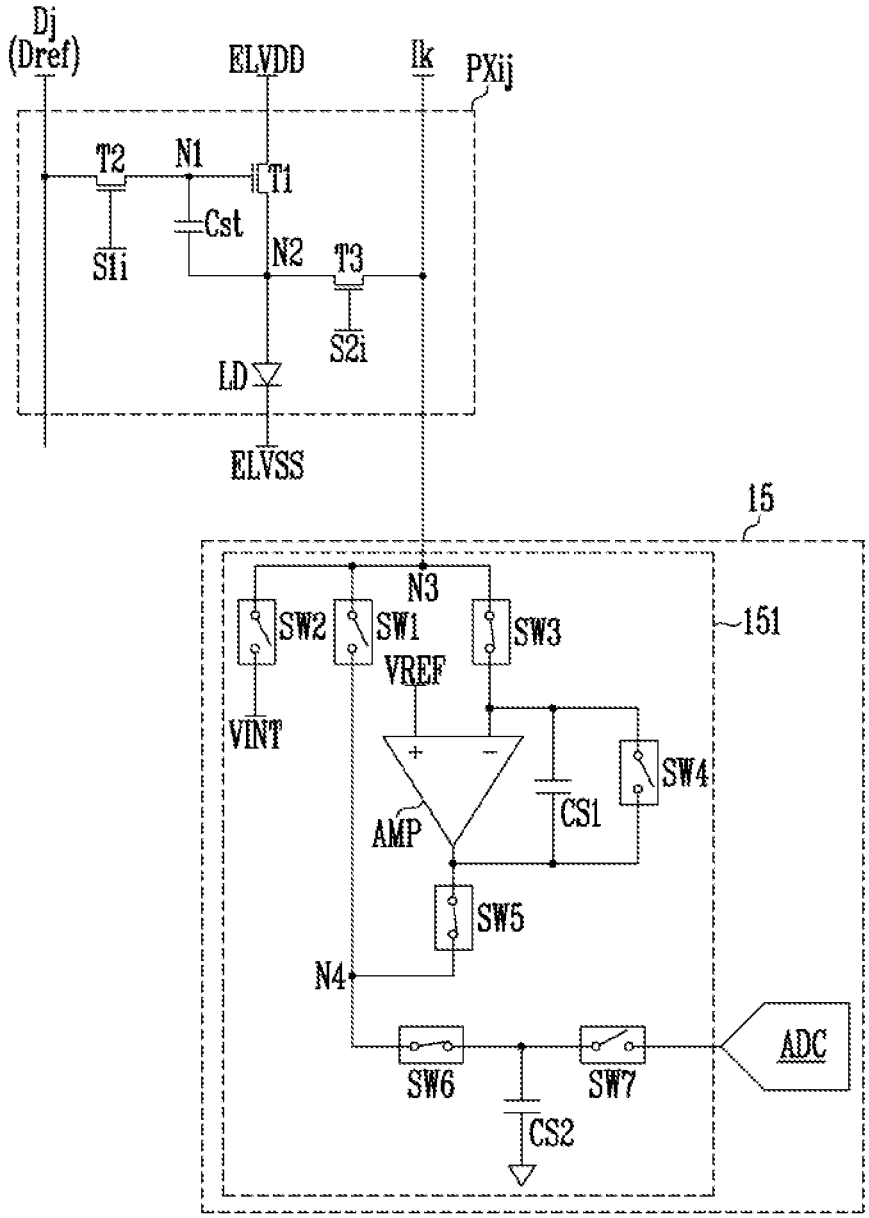

FIGS. 9 to 11 illustrate a threshold voltage sensing period of the light emitting diode in accordance with an embodiment of the present disclosure. Referring to FIG. 11, a state of the pixels PXij and the sensing channel 151 at a time td4 shown in FIG. 9 is illustrated.

At a time td1, a sensing voltage SSId may be applied to the data line Dj. The voltage of the reference power source VREF may be applied to the sensing line Ik through the third switch SW3. Scan signals having a turn-on level may be applied to the scan lines S1*i* and S2*i*, and the second transistor T2 and the third transistor T3 may be turned on. Accordingly, the storage capacitor Cst may store a difference between the sensing voltage SSId and the voltage of the reference power source VREF. For example, when a sensing current is measured, a voltage, such as the sensing voltage SSId, corresponding to reference grayscale data may be applied to the first node N1. The reference grayscale data may be data obtained by compensating for a characteristic of the first transistor T1. The characteristic of the first transistor T1 may include at least one of a threshold voltage of the first transistor T1 and a mobility.

At a time td2, scan signals having a turn-off level may be applied to the first scan line S1*i* and the second scan line S2*i*. Since the turn-on state of the first transistor T1 is maintained by the storage capacitor Cst, the voltage of the second node N2 may be increased corresponding to a degradation degree of the light emitting diode LD. For example, the voltage of the second node N2 may become higher as the degradation degree of the light emitting diode LD becomes more serious. A voltage converging in the second node N2 may correspond to the threshold voltage of the light emitting diode LD.

At a time td3, scan signals having a turn-on level may be applied to the first scan line S1*i* and the second scan line S2*i*. A data reference voltage Dref may be applied to the data line Dj. The data reference voltage Dref may be a voltage having a turn-off level. Therefore, the voltage of the second node N2 may be stably sensed by the sensing channel 151, in a state in which the first transistor T1 maintains the turn-off state. The fourth switch SW4 may be in the turn-off state while the sensing channel 151 is sensing the voltage of the second node N2.

Since the third switch SW is in the turn-on state, and the voltage of the third node N3 is fixed to the voltage of the reference power source VREF, the voltage of the fourth node N4 may become lower as the magnitude of the voltage of the second node N2 becomes higher due to the quantity of supplied charges becoming larger. The voltage of the fourth node N4 may be stored in the sampling capacitor CS2, and the analog-to-digital converter ADC may the stored voltage into a digital value. Accordingly, characteristic information of the light emitting diode LD, which corresponds to the threshold voltage, may be sensed in the form of a sensing current. In order to prevent the sensing current from flowing through the light emitting diode LD, the voltage of the second power source ELVSS may be set higher than the voltage of the first power source ELVDD, while the sensing current is being measured.

FIG. 10 illustrates a method for sensing characteristic information corresponding to the threshold voltage of the light emitting diode in the form of a sensing current, which is different from the method shown in FIG. 9. That is, as shown in FIG. 10, a sensing current may be measured, which is generated as the first transistor T1 is turned on when the sensing voltage SSId having a turn-on level is applied to the first node Ni through the data line Dj.

Referring to FIG. 10, at a time te1, scan signals having a turn-on level may be applied to the first scan line S1*i* and the second scan line S2*i*, and the sensing voltage SSId having a turn-on level may be applied to the data line Dj. The scan signal applied to the first scan line S1*i* and the sensing voltage SSId applied to the data line Dj may be continuously applied until a time te2, and the scan signal applied to the second scan line S2*i* may be applied in the form of a pulse before the time te2. Accordingly, a voltage applied to the anode of the light emitting diode LD by the scan signal applied to the second scan line S2*i* at the time te1 is initialized, and a predetermined voltage is generated in the second node N2 by the scan signal applied to the first scan line S1*i* and the sensing voltage SSId applied to the data line Dj.

At the time te2, a scan signal having a turn-off level may be applied to the first scan line S1*i*, a scan signal having a turn-on level may be applied to the second scan line S2*i*, and the sensing voltage SSId having a turn-off level may be applied to the data line Dj. The voltage of the second node N2 may be stably sensed by the sensing channel 151, in a state in which the first transistor T1 maintains the turn-off state.

From a time te3 to a time te4, a scan signal having a turn-on level is applied to the first scan line S1*i*. Accordingly, the sensing voltage SSId having a turn-off level is applied to the gate electrode of the first transistor T1, so that the voltage applied to the second node N2 may be reset.

Hereinafter, a method for updating a block degradation accumulated value will be described in detail with reference to a flowchart shown in FIG. 12.

Figure 12:
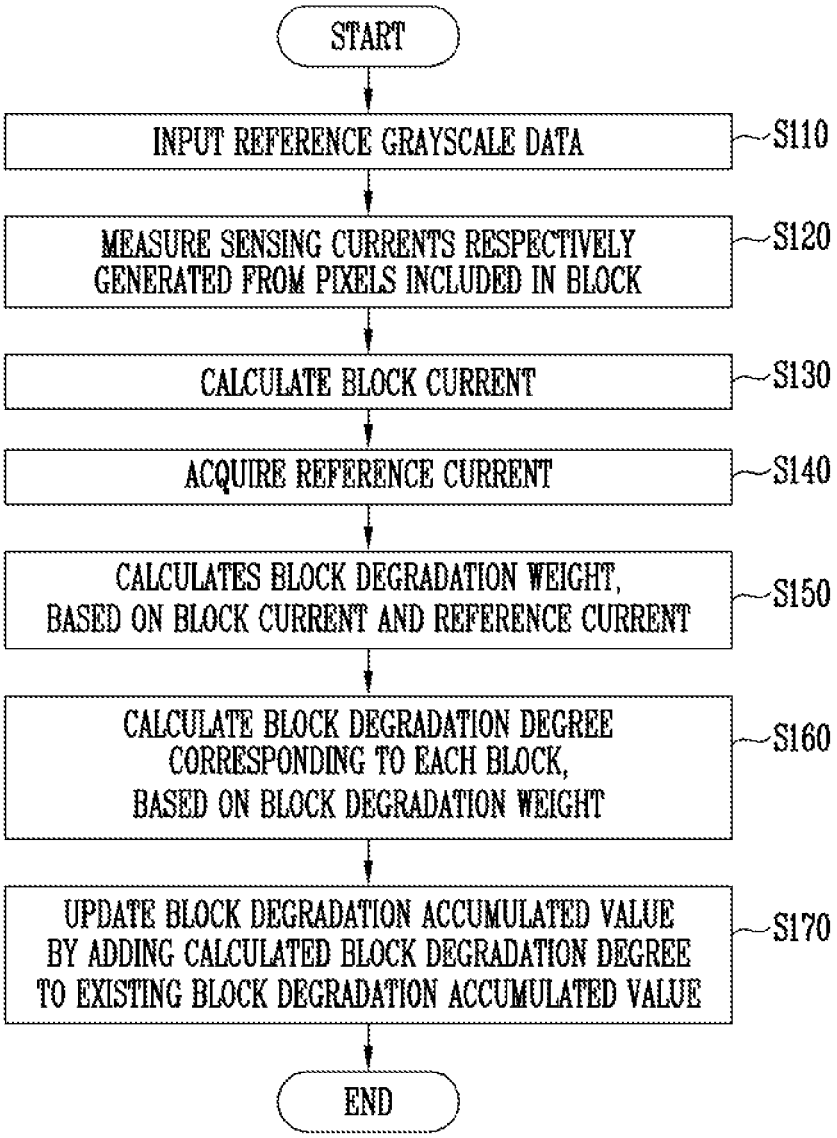
FIG. 12 is a diagram illustrating an embodiment in which a compensator updates a block degradation accumulated value by calculating a degradation degree.

FIG. 12 illustrates an embodiment in which the compensator updates a block degradation accumulated value by calculating a degradation degree.

Referring to FIG. 12, the display device 10 in accordance with the embodiment of the present disclosure outputs reference grayscale data received from the external processor (S110). For example, the compensator 16 outputs the received reference grayscale data, or reference grayscale value, to the timing controller 11 such that the data driver 12 outputs a grayscale value corresponding to the reference grayscale data.

Next, the display device 10 measures sensing currents respectively generated from pixels included in a block (S120), and calculates a block current, based on the measured sensing currents (S130). Referring back to FIG. 2, for example, the sensing unit 15 may measure sensing currents respectively generated from a plurality of pixels, such as PX1, PX2, PX3, or the like included in a block, such as a first block BL1, a second block BL2, a third block BL3, or the like, and calculate a block current for each of the blocks BL1, BL2, and BL3, or the like, based on the measured sensing currents. In an example, the block current may be a sum of sensing currents respectively generated from a plurality of pixels, such as PX1, included in a specific block, such as a first block BL1. In another example, the block current may be an average value obtained by dividing sensing currents respectively generated from a plurality of pixels, such as from PX1, included in a specific block, such as a first block BL1, by a number of the plurality of pixels. However, the present disclosure is not limited thereto.

Next, the display device 10 acquires a predetermined reference current (S140). For example, the compensator 16 may acquire a reference current value stored in the memory.

Next, the display device 10 calculates block degradation weights corresponding to the respective blocks, based on the block current and the reference current (S150).

The above-described degradation weight, or block degradation weight, may be determined based on a ratio of a sensing current to the reference current. Specifically, the degradation weight or block degradation weight WP may be determined by the following Equation 2.

$$WP = \left(\frac{I_s}{I_r}\right)^{\alpha} \quad \text{(Equation 2)}$$

In Equation 2, $I_r$ denotes a reference current, $I_s$ denotes a sensing current, and a denotes a current acceleration factor. The current acceleration factor may be pre-stored in the memory before a product is released, and be actively redefined when the product is used.

Next, the display device 10 calculates, for each of the blocks, a block degradation degree corresponding to the block, based on the block degradation weight WP (S160), and updates a block degradation accumulated value by adding the calculated block degradation degree to the existing block degradation accumulated value (S170).

The first block BL1 will be described as an example. The compensator 16 may generate a block degradation degree corresponding to the first block BL1 by multiplying a first block representative value of input grayscale values, a first block temperature, and a first degradation weight corresponding to the first block BL1. Also, the compensator 16 may update a block degradation accumulated value correspond to the first block BL1 in an Nth image frame by adding the block degradation degree corresponding to the first block BL1 to a block degradation accumulated value in an (N−1)th image frame per Equation 3.

$$ACD1[n]=ACD1[n-1]+WP1*BRV1[n]*TP1 \quad \text{(Equation 3)}$$

In Equation 3, ACD1[n−1] may be a block degradation accumulated value of the first block BL1 until an (n−1)th image frame, BRV1[n] may be a first grayscale acceleration value, or first block representative value of input grayscale values, of the first block BL1 in an nth image frame, TP1 may be a first block temperature, WP1 may be a degradation weight of the first block BL1, and ACD1[n] may be a block degradation accumulated value of the first block BL1 until the nth image frame. The embodiment in which the block degradation accumulated value is updated using the above-described Equation 3, etc. has been described based on the first block BL1. However, the present disclosure is not limited thereto, and the embodiment may be applied to all the other blocks, such as BL2 and BL3 included in the display unit 14.

The block representative value may be a value obtained by applying weights to input grayscale values of a corresponding block and dividing a number of the input grayscale values into the weights. For example, when the weights of the input grayscale values are the same as 1, the block representative value may mean an average value. In another example, the block representative value may be a value obtained by adding up the input grayscale values of the corresponding block. In still another example, the block representative value may correspond to a Most Significant Bit (MSB) of the value obtained by adding up the input grayscale values of the corresponding block.

In Equation 3, WP1*BRV1[n]*TP1 may be a block degradation degree. That is, the block degradation degree in the nth image frame may become larger, as the first block representative value BRV1[n] in the nth image frame becomes larger and as the first block temperature TP1 becomes higher. The block degradation degree may correspond to a degradation degree of light emitting diodes LD included in pixels include in the corresponding block. When the light emitting diode LD is degraded, a larger amount of driving current is required to emit light with a luminance at the same level.

The degradation accumulated value (or block degradation accumulated value, e.g., ACD[n]) may increase as the degradation degree (or block degradation degree, e.g., WP*BRV[n]*TP) increases. The degradation degree (or block degradation degree, e.g., WP*BRV[n]*TP) may increase as the degradation weight, or block degradation weight such as WP, increases.

The display device 10 may generate an output grayscale value by reflecting the updated block degradation accumulated value to the input grayscale value. For example, the compensator 16 may generate a block output grayscale value for each block by reflecting the updated block degradation accumulated value to the input grayscale value.

As described above, the compensator 16 may compensate each block by accumulating block degradation accumulated values of the block. However, when an output grayscale value of a specific block is remarkably different from those of adjacent blocks, it is necessary to compensate only the specific block. Hereinafter, a method for updating a block degradation accumulated value with respect to a specific block will be described in detail with reference to a flowchart shown in FIG. 13.

Figure 13:
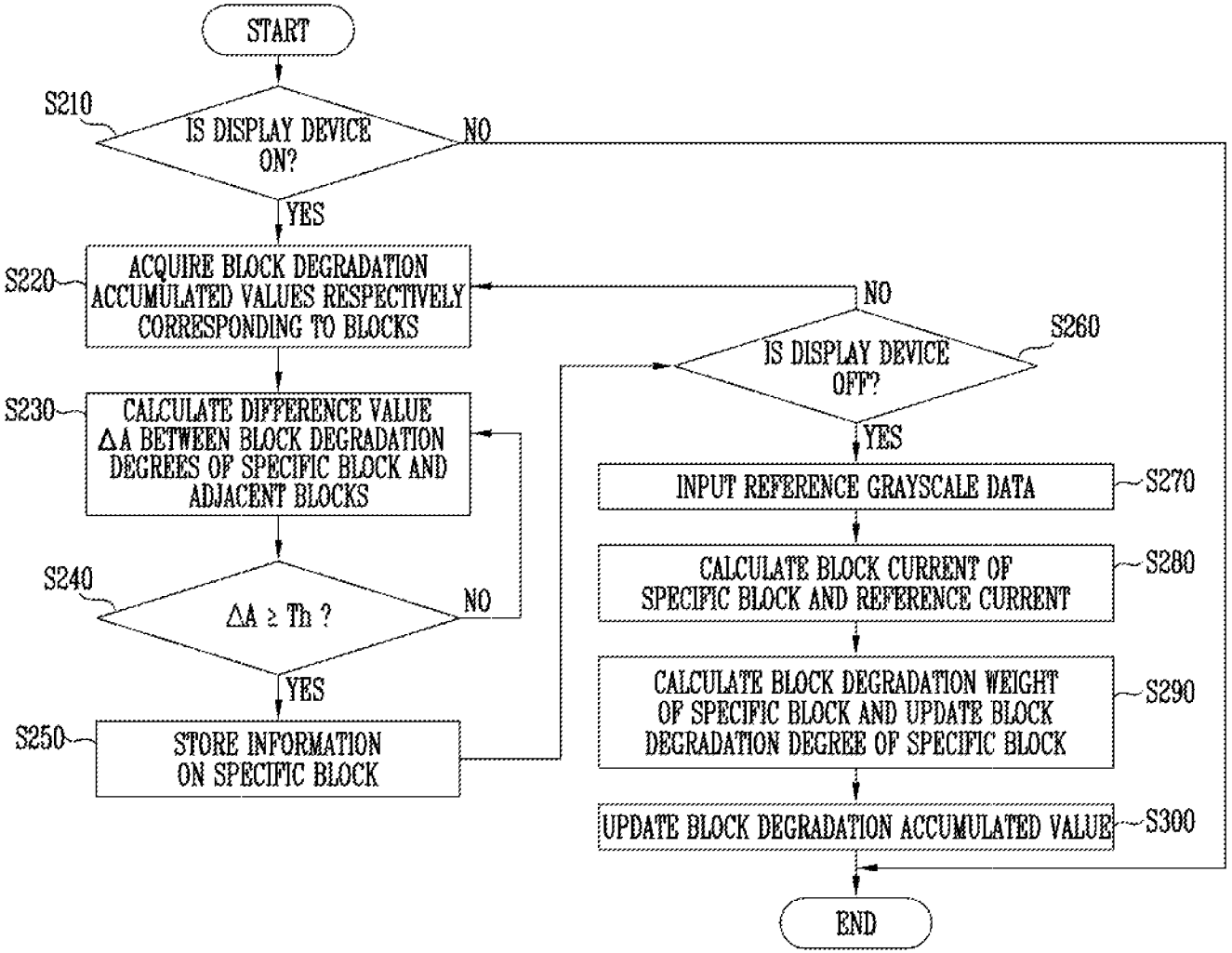
FIG. 13 is a diagram illustrating an embodiment in which a block degradation accumulated value is updated with respect to a specific block.

FIG. 13 illustrates an embodiment in which a block degradation accumulated value is updated with respect to a specific block.

Referring to FIG. 13, the display device 10 in accordance with the embodiment of the present disclosure checks whether it is on (S210). Specifically, the compensator 16 may check whether the display device is turned on.

When the display device 10 is on (S210) (Yes), the display device 10 acquires block degradation degrees respectively corresponding to blocks (S220). The block degradation degrees may be determined by currents respectively generated in the blocks to display input grayscale values and WP*BRV[n]*TP in the above-described Equation 3.

The first block BL1 and the second block BL2, which are shown in FIG. 2, will be described as an example. The compensator 16 may acquire a first block degradation degree WP1*BRV1[n]*TP1 corresponding to the first block BL1 and a second block degradation degree WP2*BRV2[n]*TP2 corresponding to the second block BL2 adjacent to the first block BL1. The second block BL2 shown in FIG. 2 is adjacent to one side of the first block BL1, but the present disclosure is not limited thereto. Therefore, the above-described example may be equally applied to blocks adjacent to the other side of the first block BL1, such as the third block BL3. In addition, "first" and "second" are not limited to those shown in FIG. 2.

The display device 10 calculates a difference value ΔA between block degradation degrees of a specific block and adjacent blocks (S230), and compares the difference value ΔA and a predetermined reference value (S240). When the difference value ΔA is the predetermined reference value or more (S240) (Yes), the display device 10 stores information on the specific block (S250). Referring to FIG. 2, for example, the compensator 16 may calculate a difference value ΔA between the first block degradation degree WP1*BRV1[n]*TP1 corresponding to the first block BL1 and the second block degradation degree WP2*BRV2[n] *TP2 corresponding to the second block BL2. When the difference value ΔA is the reference value or more, information on the first block BL1 may be stored.

Next, the display device 10 checks whether it is off (S260). When the display device 10 is still on (S260) (No), the step S220 is again performed.

When the display device 10 is off (S260) (Yes), the display device 10 inputs reference grayscale data received from the external processor (S270), calculates a block current of the specific block and then acquires a reference current (S280), calculates a block degradation weight of the specific block and then updates a block degradation degree of the specific block (S290), and updates a block degradation accumulated value of the specific block (S300). A case where the stored specific block is the first block BL1 will be described as an example. The compensator 16 may check whether the display device 10 has been turned off. When the display device 10 is turned off, the compensator 16 may calculate a block current corresponding to the stored first block BL1, calculates a block degradation weight WP1, based on a block current value corresponding to the first block BL1 and a reference current value pre-stored in the memory, and update a block degradation accumulated value by accumulating a first block degradation degree to which the block degradation weight WP1 is reflected.

In another embodiment, the compensator 16 may compare difference values between block degradation accumulated values, such as ACD[N] of the blocks with the above-described reference value, and store information on a specific block having a difference value which is the reference value or more. For example, the compensator 16 may calculate a difference value between a first block degradation accumulated value, such as ACD1[n] of the first block BL1 and a second block degradation accumulated value, such as ACD2[n] of the second block BL2, and store information on the first block BL1, when the difference value is the reference value or more.

FIG. 14 illustrates a display device in accordance with another embodiment of the present disclosure.

Referring to FIG. 14, the display device 10 in accordance with the embodiment of the present disclosure may include a timing controller 11, a data driver 12, a scan driver 13, a display unit 14, a current sensor 15_1, a compensator 16, a temperature sensor 17, and the like.

The timing controller 11, the data driver 12, and the temperature sensor 17 are identical to those described with reference to FIG. 1, and therefore, their descriptions will be omitted.

The scan driver 13 shown in FIG. 14 is different from that shown in FIG. 1, in that the first scan lines S11, S12, . . . , and Sin and the second scan lines S21, S22, . . . , and Stn, which are shown in FIG. 1, are integrated as scan lines S1, S2, S3, . . . , Si, S(i+1), . . . , and Sm. Here, m and i may be integers greater than 0.

The display unit 14 includes pixels PXij, PXi(j+1), and PX(i+1)j. Each of the pixels PXij, PXi(j+1), and PX(i+1)j may be coupled to a corresponding data line and a corresponding scan line. In the pixel PXij, a scan transistor may be coupled to an ith scan lines Si and a jth data line Dj. In the pixel PXi(j+1), a scan transistor may be coupled to the ith scan line Si and a (j+1)th data line D(j+1). In the pixel (i+1)j, a scan transistor may be coupled to an (i+1)th scan line S(i+1) and the jth data line Dj. The pixels PXij, PXi(j+1), and PX(i+1)j may be commonly coupled to a first power line ELVDDL. The pixels PXij, PXi(j+1), and PX(i+1)j may be commonly coupled to a second power line ELVSSL. In another embodiment, the pixels PXij, PXi(j+1), and PX(i+1)j may be coupled to different second power lines. That is, different second power voltages may be applied to the pixels PXij, PXi(j+1), and PX(i+1)j.

In accordance with another embodiment, the pixels PXij, PXi(j+1), and PX(i+1)j may be commonly coupled to the second power line ELVSSL, and be coupled to different first power lines. Unlike the embodiment shown in FIG. 1, the current sensor 15_1 of FIG. 14 may be coupled to the second power line ELVSSL, to sense a current flowing in the second power line ELVSSL.

The current sensor 15_1 of FIG. 14 may be included in addition to or instead of the sensing unit 15 of FIG. 1, without limitation. When included without a sensing unit 15, sensing lines I1 through Ip may be similarly be omitted.

The display unit 14 may be divided into a plurality of blocks BL1 and BL2. Each of the blocks BL1 and BL2 may include at least one pixel. For example, a first block BL1 may include pixels PXij and PX(i+1)j, and a second block BL2 may include a pixel PXi(j+1). However, the present disclosure is not limited thereto.

The current sensor 15_1 may be coupled to the first power line ELVDDL. The current sensor 15_1 may provide a sensing current value by sensing a sensing current flowing in the first power line ELVDDL. As described above, in another embodiment, the current sensor 15_1 may be coupled to the common second power line ELVSSL of the pixels PXij, PXi(j+1), and PX(i+1)j. The current sensor 15_1 may provide a sensing current value by sensing a current flowing in the second power line ELVSSL. Since the current sensor 15_1 is coupled to a common power line of all the pixels of the display unit 14, the embodiments of the present disclosure may be implemented even when only one current sensor is provided.

In an embodiment, as described above, the current sensor 15_1 may measure sensing currents respectively generated from a plurality of pixels PXij, PXi(j+1), and PX(i+1)j included in a block, such as BL1 or BL2, and calculate a block current for each of the blocks BL1 and BL2, based on the measured sensing currents.

The display device 10 may allow the blocks BL1 and BL2 to sequentially emit light, and the current sensor 15_1 may provide sensing current values at each time. The sensing current values may be sequentially stored, and block current values respectively corresponding to the blocks BL1 and BL2 may be sequentially stored. For example, the pixels PXij and PX(i+1)j of the first block BL1 may emit light in a first period, and may not emit light in a second period after the first period. The pixel PXi(j+1) of the second block BL2 may not emit light in the first period, and may emit light in the second period. The current sensor 15_1 may provide a first sensing current value by sensing a current flowing in the first power line ELVDDL in the first period, and provide a second sensing current value by sensing a current flowing in the first power line ELVDDL in the second period. A memory may store the first sensing current value (or first block current value) and store the second sensing current value (or second block current value).

A process of storing block current values may be performed once when the display device 10 is power on. In other embodiments, the time at which the process is performed may be variously set, and the process may be performed plural times.

The compensator 16 may be coupled to the current sensor 15_1 and the timing controller 11. The compensator 16 shown in FIG. 14 is different from the compensator 16 shown in FIG. 1, in that the compensator 16 may calculate a degradation degree of each of the blocks BL1 and BL2, based on the sensing current value provided from the current sensor 15_1 and a reference current value stored in the memory. The compensator 16 shown in FIG. 14 is identical to the compensator 16 shown in FIG. 1 in the other portions. That is, the compensator 16 shown in FIG. 14 may calculate a block degradation weight, update a block degradation accumulated value, and output a block output grayscale value. Also, the compensator 16 shown in FIG. 14 may store information on a specific block, such as the first block, having a difference value which is a predetermined reference value or more by calculating a difference value between block degradation degrees of adjacent blocks. In addition, when the display device is turned off, the compensator 16 shown in FIG. 14 may update a block degradation accumulated value corresponding to a specific block, such as the first block, and output a block output grayscale value corresponding to only the specific block.

As described above, there may be provided a display device capable of sensing characteristic information of each pixel with respect to positions of the pixel and accurately compensating for the characteristic information with respect to the positions of the pixel, and a driving method of the display device.

Exemplary embodiments have been disclosed herein, and although specific terms are employed, they are used and are to be interpreted in a generic and descriptive sense only and not for purposes of limitation. In some instances, as would be apparent to one of ordinary skill in the art as of the filing of the present application or its priority case, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the pertinent art that various changes in form and details may be made without departing from the spirit and scope of the present disclosure as set forth in the following claims.

What is claimed is:

1. A display device comprising:

a display unit including pixels connected to signal lines;

a sensing unit including at least one current sensor connected to at least one of the signal lines; and a compensator connected between the sensing unit and the display unit, wherein the pixels are grouped into blocks, wherein the compensator is configured to:

calculate degradation weights for positions of the pixels, based on a sensing current measured by the sensing unit and a predetermined reference current value, update degradation accumulated values for the positions whenever the sensing current is measured, by accumulating degradation degrees in which the degradation weights are reflected, generate compensated grayscale values by compensating input grayscale values based on the updated degradation accumulated values, output the compensated grayscale values to the pixels, acquire a first block degradation degree corresponding to a first block and a second block degradation degree corresponding to at least one second block adjacent to the first block, calculate a difference value between the first block degradation degree and the second block degradation degree, store information on the first block, when the difference value is a predetermined reference value or more, and check whether the display device has been turned off.

2. The display device of claim 1, wherein a quantity of the blocks is smaller than or equal to a quantity of the pixels, wherein the sensing unit measures sensing currents respectively generated from the pixels included in each block, and calculates a block current for each of the blocks, based on the measured sensing currents, respectively.

3. The display device of claim 2, wherein the compensator:

calculates a respective block degradation weight corresponding to each respective block, based on the respective block current value and the reference current value;

reflects each respective block degradation weight to a respective block degradation degree corresponding to the respective block, and updates a respective block degradation accumulated value by accumulating the respective block degradation degree; and generates a respective block output grayscale value for each respective block by reflecting the updated respective block degradation accumulated value to the respective input grayscale value.

4. The display device of claim 2, wherein the compensator:

calculates a block current corresponding to the first block, when the display device is turned off;

calculates a block degradation weight, based on a block current value corresponding to the first block and the reference current value; and updates a block degradation accumulated value by accumulating the first block degradation degree to which the block degradation weight is reflected.

5. The display device of claim 1, wherein each of the pixels includes:

a first transistor including a gate electrode coupled to a first node, a first electrode coupled to a first power source, and a second electrode coupled to a second node;

a second transistor including a gate electrode coupled to a first scan line, a first electrode coupled to a data line, and a second electrode coupled to the first node;

a third transistor including a gate electrode coupled to a second scan line, a first electrode coupled to the second node, and a second electrode coupled to a sensing line; and a light emitting diode including an anode coupled to the second node and a cathode coupled to a second power source.

6. The display device of claim 5, wherein, when the sensing current is measured, a voltage corresponding to reference grayscale data is applied to the first node, and wherein the reference grayscale data is data obtained by compensating for a characteristic of the first transistor.

7. The display device of claim 6, wherein the characteristic includes at least one of a threshold voltage of the first transistor and a mobility.

8. The display device of claim 5, wherein a voltage of the second power source is set higher than that of the first power source while the sensing current is being measured.

9. The display device of claim 1, wherein the degradation accumulated values increase as the degradation degrees increase, wherein the degradation degrees increase as the degradation weights increase, wherein the degradation weights are determined based on a ratio of the sensing current value to the reference current value.

10. The display device of claim 1, further comprising a temperature sensor configured to measure an ambient temperature of the display unit, wherein the compensator accumulates the degradation degrees by reflecting input grayscale values for the pixels and the ambient temperature to the degradation degrees.

11. The display device of claim 1, the sensing unit comprising:

a current sensor configured to measure a sensing current flowing in a first power line of the signal lines, and provide a corresponding sensing current value.

12. The display device of claim 11, wherein a quantity of the blocks is smaller than or equal to a quantity of the pixels, wherein the current sensor measures sensing currents respectively generated from a plurality of pixels included in a respective block, and calculates a block current for each of the blocks, based on the measured sensing currents.

13. The display device of claim 12, wherein the compensator:

calculates a block degradation weight corresponding to the block, based on a block current value and the reference current value;

reflects the block degradation weight to a block degradation degree corresponding to the block, and updates a block degradation accumulated value by accumulating the block degradation degree; and generates a block output grayscale value for the block by reflecting the updated block degradation accumulated value to a respective input grayscale value.

14. The display device of claim 12, wherein the compensator:

acquires a first block degradation degree corresponding to a first block and a second block degradation degree corresponding to at least one second block adjacent to the first block;

calculates a difference value between the first block degradation degree and the second block degradation degree; and stores information on the first block, when the difference value is a predetermined reference value or more.

15. The display device of claim 14, wherein the compensator:

checks whether the display device has been turned off;

calculates a block current corresponding to the first block, when the display device is turned off;

calculates a block degradation weight, based on a block current value corresponding to the first block and the reference current value; and updates a block degradation accumulated value by accumulating the first block degradation degree to which the block degradation weight is reflected.

16. A method for driving a display device, the method comprising:

measuring a sensing current for each of pixels included in the display device, and outputting a sensing current value, wherein the pixels are grouped into blocks;

calculating a degradation weight for each of positions of the pixels, based on the sensing current value and a predetermined reference current value;

updating a degradation accumulated value whenever the sensing current is measured by accumulating a degradation degree to which the degradation weight is reflected;

generating an output grayscale value by reflecting the updated degradation accumulated value to an input grayscale value input from the outside;

acquiring a first block degradation degree corresponding to a first block and a second block degradation corresponding to at least one second block adjacent to the first block;

calculating a difference value between the first block degradation degree and the second block degradation degree;

storing information on the first block, when the difference value is a predetermined reference value or more; and checking whether the display device has been turned off.

17. The method of claim 16, wherein a quantity of the blocks is smaller than or equal to a quantity of the pixels, wherein, in the outputting of the sensing current value, sensing currents respectively generated from a plurality of pixels included in a block are measured, and a block current is calculated for each of the blocks, based on the measured sensing currents.

18. The method of claim 17, wherein, in the calculating of the degradation weight, a block degradation weight corresponding to the block is calculated based on a block current value and the reference current value, wherein, in the updating of the degradation accumulated value, the block degradation weight is reflected to a block degradation degree corresponding to the block, and a block degradation accumulated value is updated by accumulating the block degradation degree, wherein, in the generating of the output grayscale value, a block output grayscale value for the block is generated by reflecting the updated block degradation accumulated value to the input grayscale value.

19. The method of claim 16, wherein the degradation accumulated value increases as the degradation degree increases, wherein the degradation degree increases as the degradation weight increases, wherein the degradation weight is determined based on a ratio of the sensing current value to the reference current value.

* * * * *